US007584726B2

(12) United States Patent
Choronski et al.

(10) Patent No.: US 7,584,726 B2
(45) Date of Patent: Sep. 8, 2009

(54) TWO-STROKE OPPOSITE RADIAL ROTARY-PISTON ENGINE

(76) Inventors: Evgeni Choronski, Str. Lashich 1 Apt 58, Ashkelon (IL) 78714; Boris Moukhaev, Yoa Khin Ha Melech 9, Apt 32, Ashdod (IL) 77483

( * ) Notice: Subject to any disclaimer, the term of this patent is extended or adjusted under 35 U.S.C. 154(b) by 301 days.

(21) Appl. No.: 11/827,595

(22) Filed: Jul. 12, 2007

(65) Prior Publication Data

US 2008/0271687 A1 Nov. 6, 2008

Related U.S. Application Data

(60) Provisional application No. 60/881,208, filed on Jan. 19, 2007.

(51) Int. Cl.
*F01B 7/12* (2006.01)
*F01M 1/02* (2006.01)

(52) U.S. Cl. ..... 123/51 BD; 123/69 R; 123/196 R

(58) Field of Classification Search ..... 123/51 R, 123/51 B, 51 BD, 65 R, 69 R, 65 BA, 196 R
See application file for complete search history.

(56) References Cited

U.S. PATENT DOCUMENTS 4,334,506 A 6/1982 Albert
6,161,508 A 12/2000 Lindblad
6,279,518 B1 8/2001 Cooley, Sr.

FOREIGN PATENT DOCUMENTS

FR 2613770 A * 10/1988

* cited by examiner

*Primary Examiner*—Noah Kamen
(74) *Attorney, Agent, or Firm*—Aleksandr Smushkovich

(57) ABSTRACT

A two-stroke opposite rotary-piston engine comprises a cylinder block including a sleeve and two pistons slidely disposed therein, oppositely movable forming a common combustion chamber and a first gap with sleeve's sidewalls, a rotor having a surface formed by an ellipse or Cassini line, traverses attached to the pistons, rollers attached to the traverses and springly depressed against the rotor, oil tubes with end bushings, oil supply and withdraw means, two plungers disposed in each tube forming a second gap essentially less than the first. The plungers are attached to the traverses and oppositely movable, including through channels, outward surfaces with the bushings forming external spaces, and inward surfaces with the tube sidewalls forming an internal space communicating with the oil supply and withdraw means. Oil drain means communicate the external spaces with the oil supply means. The engine absorbs side and inertial forces, is more efficient and clean.

3 Claims, 4 Drawing Sheets

SECTION B-B

TWO-STROKE OPPOSITE RADIAL ROTARY-PISTON ENGINE

CROSS-REFERENCE TO RELATED APPLICATION

This application claims the benefit according to 35 U.S.C. 119(e) of a U.S. provisional patent application Ser. No. 60/881,208, filed on Jan. 19, 2007, the disclosure of which is incorporated herein in its entirety by reference.

FIELD OF THE INVENTION

The invention relates to opposite radial rotary-piston engines that can be utilized in ground vehicles, water vehicles, aircraft, in combinations with generators, etc.

BACKGROUND OF THE INVENTION

In the prior art there are known several constructions of centrifugal-piston or rotary-piston engines (herein further called ORPE), which are intended to eliminate certain disadvantages of conventional piston engines. E.g., such constructions are described in DE3907307, U.S. Pat. No. 6,279,518, WO2005098202, RU2143572, JP7113452. The latter, for instance, has the purpose "to suppress the side pressure applied to a piston, improve efficiency, reduce vibration and drastically reduce dimension and weight, by revolving a cam on the inner wall of an ellipse without using a crank, in reciprocating motion." The other above indicated constructions typically have similar purposes.

DE3907307 discloses a four-stroke engine wherein a cylinder block revolves inside a rotor, which is complicated, has a small resource of the valve system, and a des-balance with the revolving system including movable parts.

U.S. Pat. No. 6,279,518 discloses a four-stroke engine having a valve system and a conically shaped rotor. FIG. 7 shows a conical rotor with an elliptical groove, and a series of pistons followers inside the groove. It is a complicated unit with substantial friction losses, which has a limited operation resource for its loaded parts. The construction does not eliminate the side forces exerted by the piston upon the cylinder walls.

RU 2143572 discloses a four-stroke engine, wherein the cylinder block revolves at an elliptical trajectory, and the inlet/outlet system includes a rotatable valve. The construction is complicated and difficult to balance (which is admitted by its author). The piston acts via its rod and a sliding bearing upon an elliptical housing. The place of contact with the housing experiences high friction and heating, and thus will have a short operation resource.

From the inventors point of view, a more advanced design of OPRE is presented in U.S. Pat. No. 6,161,508. It describes "a radial-piston engine of rotary type of the kind having a valve system comprising apertured disc rings arranged in intersliding relationship, one of said rings being stationary while the other one is arranged to take part in the rotary motion of the rotor. The valve opening relationship is determined by the manual angular positions of the discs. In accordance with the invention, filed injection takes place via an injection nozzle positioned in the stationary disc. The valve ring is formed with a through opening which in response to the position assumed my the rotor at the moment of fuel ignition forms an open communication means between the injection nozzle and the combustion chamber."

That engine however has also certain drawbacks and limitations. It is built as a four-stroke engine having a cylinder block revolving around and impelling a rotor. Reaction forces produced in support bearings are very significant that leads to a short operation resource period. It uses an inlet/outlet system based on a rotatable sliding valve. This necessitates the use of complicated sealing means that, as a rule, have very limited operation resource (typically 100 hours maximum). The rotating cylinder block with linearly reciprocating pistons is very hard to balance, and thusly will cause intensive destructive vibrations. These problems are successfully resolved in the present invention.

BRIEF DESCRIPTION OF THE INVENTION

The inventive ORPE employs the mentioned non-typical form of conversion of the spinning motion of a rotor into a progressive linear stroke of a piston, and vice versa. This constructive solution provides for substantial absorption of side forces exerted by the piston onto engine cylinder's walls and vice-versa, and for an essential improvement of the weight and fuel consumption/power output ratios, demonstrating useful advantages over all presently utilized engines known to the inventors, including the Wankel rotor engine.

The most important advantages of the invention are a simple design, low mass, long operation resource (supposedly over 1,000,000 km), low fuel consumption and high power torque, low level of pollutions (environmentally-friendly).

The engine's weight (without attached devices) is estimated about 30 kg. It has a displacement of 500 cc, and should deliver a 250 horse-power. In a more powerful version, the engine's own weight is estimated 65 kg (without attached devices), having a displacement of 1000 cc and should deliver a 500 horse-power.

The engines as described in the invention may be employed in different applications, such as for joint operation with generators, water and surface vehicles motors, for aircraft motors, and capable to successfully compete with traditional internal combustion engines.

The design solutions embodied in the engine's lubrication and cooling systems allow exploiting the engine at 12000-15000 rpm, which can provide for an efficient motor sports application. The construction described in the present disclosure allows developing and manufacturing engines fueled by gasoline or natural gas, as well as diesel type engines employing the inventive principles.

The inventive ORPE has a rotor's operation surface formed by a closed symmetrical ellipse-type line $$\frac{x^2}{a^2} + \frac{y^2}{b^2} = 1$$

or by a Cassini line that can be described by a formula: $(x^2+y^2)-2c^2(x^2-y^2)=a^4-c^4$, wherein 'x' and 'y' are the two-dimensional coordinates, and 'a' and 'b' are predetermined coefficients.

The present disclosure describes a two-stroke opposite rotary-piston engine that comprises a cylinder block including a sleeve and two pistons slidely disposed therein and oppositely movable, which pistons are forming a common combustion chamber situated between their heads, and forming a first gap with sleeve's sidewalls; a rotor having a surface formed by an ellipse or Cassini line; traverses attached to the pistons; rollers attached to the traverses and springly depressed against the rotor; oil tubes with end bushings; oil supply and withdraw means; two plungers disposed in each tube forming a second gap with the tube's sidewalls, essentially less than the first gap. The plungers are attached to the traverses and oppositely movable, also including through throttling channels, outward surfaces forming external spaces with the bushings, and inward surfaces forming an internal space with the tube sidewalls, which internal space communicates with the oil supply means and the oil withdraw means. Engine's oil drain means communicate the external spaces with the oil supply means. The engine absorbs side and inertial forces, is more efficient and clean.

BRIEF DESCRIPTION OF THE DRAWINGS

Similar reference numerals in the drawings generally refer to the same or similar elements in different figures. A newly introduced numeral in the description is enclosed into parentheses.

DESCRIPTION OF A PREFERRED INVENTIVE EMBODIMENT

Figure 1B:
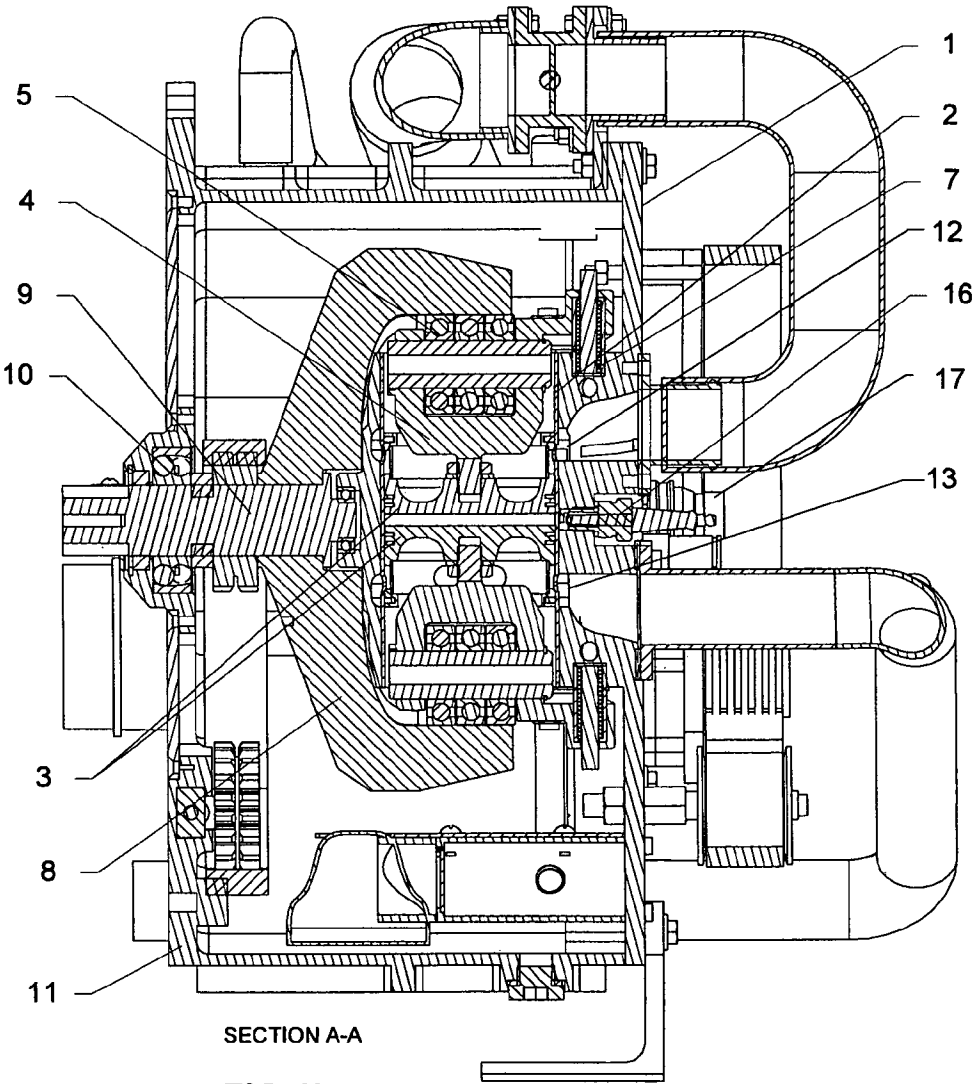
FIG. 1*b* illustrates a side sectional view of the engine in the uppermost "dead point" of the rotor and shows base units and details of the engine's construction, according to a preferred embodiment of the present invention.
Figure 1A:
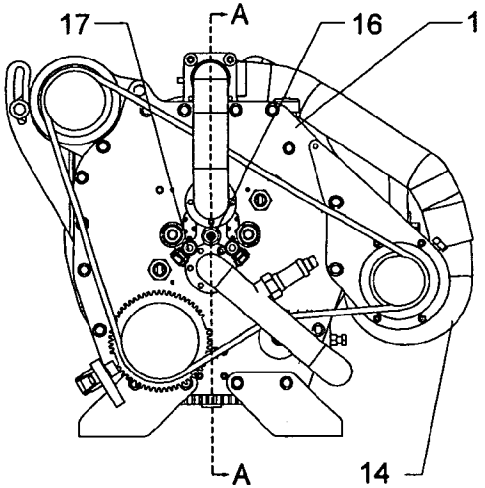
FIG. 1*a* illustrates a general frontal view of the assembled engine, according to a preferred embodiment of the present invention.

While the invention may be susceptible to embodiment in different forms, there is shown in the drawings, and will be described in detail herein, a specific embodiment of the present invention, with the understanding that the present disclosure is to be considered an exemplification of the principles of the invention, and is not intended to limit the invention to that as illustrated and described herein.

An embodiment of the inventive engine, fueled by gasoline, is illustrated in FIGS. 1*a*, 1*b*, 2*a*, 2*b*, 3*a*, and 3*b*. The engine comprises a stationary cylinder block (1) fixedly mounted, e.g. on a vehicle; a cylindrically shaped sleeve (2) mounted to the block 1; two oppositely movable cylindrical pistons (3) slidely snug-fitting in the sleeve 2. In a preferred embodiment, a first gap between the piston 3 and the sidewalls of the sleeve 2 is made in the size of about 50 micrometers.

The opposite pistons 3 each includes a bottom head. The surfaces of the bottom heads and a portion of sidewalls of the sleeve 2 (between the bottom heads) collectively form a common work chamber and a common combustion chamber.

The block 1 includes a supporting bearing (preferably ball-bearing). A spark-plug (16) and an injector (17) are installed in the block 1.

The block 1 and sleeve 2 include an inlet port (12) and outlet port (13), preferably milled out therein, to provide air supply and combustion products exhaust correspondingly. The air supply is introduced from a supercharging air compressor (14), in this embodiment mechanically driven by the engine. In other embodiments, it may be driven by other means. The compressor 14 is connected to the inlet port 12.

The engine comprises two fork-shaped traverses (4), each aforesaid traverse 4 is coupled with one of the pistons 3 by means of lock-nuts with a female threading screwable on a male threading of the traverse. The threading connection allows adjusting the compression ratio within a range of from 8 to 11 during the assembly process.

The engine comprises supporting rollers (5) to transmit forces from the pistons 3 and traverses 4, which rollers 5 are mounted to the traverses 4 by means of pins (not shown).

The engine comprises a stationary housing (11) fixedly mounted, e.g. on a vehicle. The housing 11 includes a supporting bearing (10) (preferably, a ball bearing). In FIGS. 1*a*, 1*b*, 2*a*, 2*b*, the housing 11 is conventionally shown vertically positioned, though in reality it is typically positioned horizontally. The housing 11 is filled up with oil for lubrication and other purposes as described further in the disclosure.

The engine comprises a rotor (8), having a closed inner operation surface formed by a predeterminedly curved line, for example, a closed symmetrical ellipse-type line or Cassini line mentioned hereinabove. The rotor 8 is mounted on the supporting bearing installed within the housing 11 and on the supporting bearing installed within the cylinder block 1.

The engine comprises a rotatable power takeoff shaft (9) mounted at least on the supporting bearing 10. The shaft 9 is fixed to the rotor 8. The rotation torque of the rotor 8 is transmitted to the shaft 9 and can be further conveyed to a transmission.

The traverses 4 interact with springs (7), which springs depress the supporting rollers 5 against the rotor 8, providing for a mild unstressed engaging at engine's start.

Figure 4A:
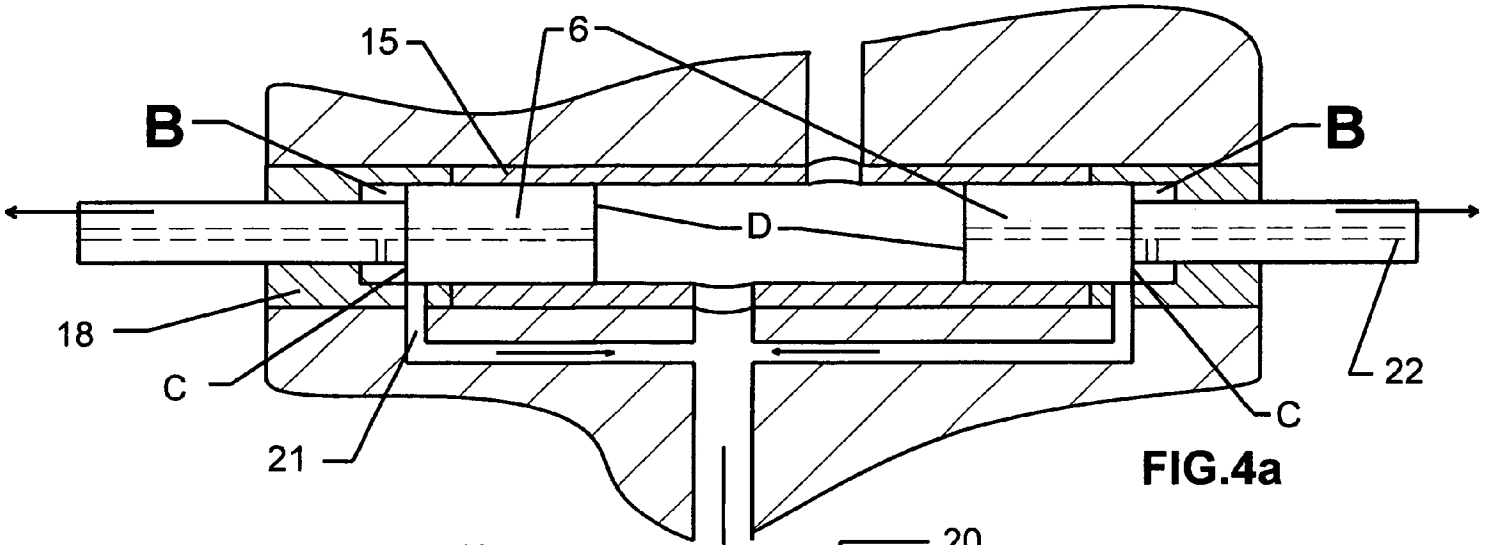
FIG. 4*a* illustrates a sectional view of the plungers' tubes and plungers at the lowermost dead-point of the engine, according to a preferred embodiment of the present invention.
Figure 4B:
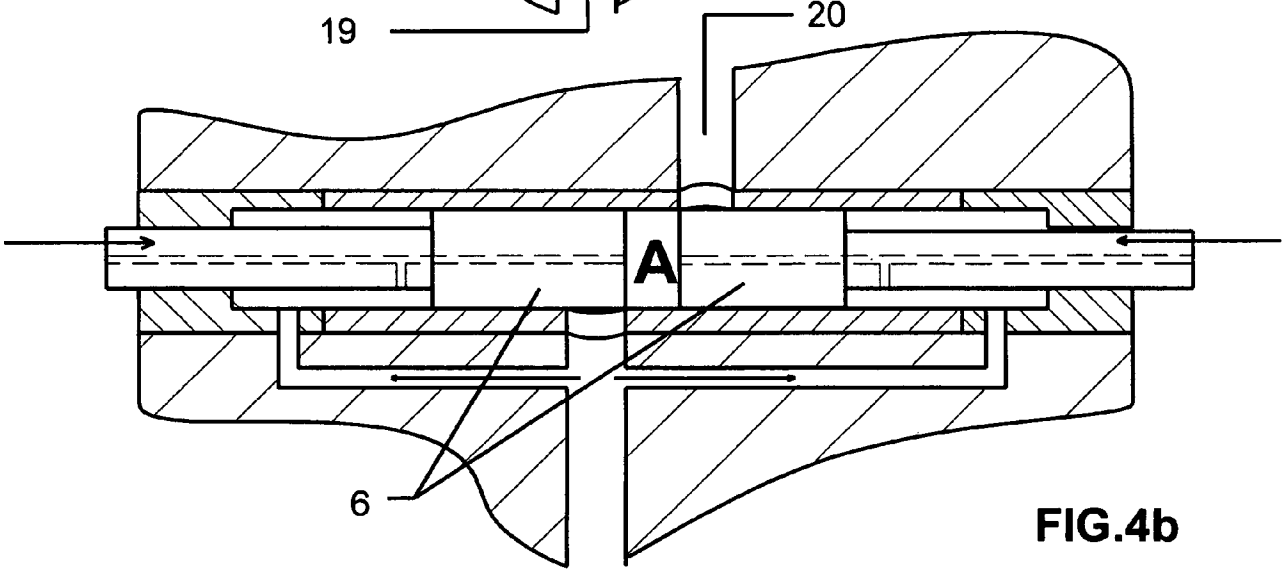
FIG. 4*b* illustrates a sectional view of the plungers' tubes and plungers at the uppermost dead-point of the engine, according to a preferred embodiment of the present invention.

As depicted in FIGS. 4*a* and 4*b*, the engine comprises an oil supply conduit (19) of low pressure with a reverse valve (not shown) mounted therein, and an oil withdraw conduit (20) of high pressure with a reverse valve and a pressure-reduction valve (both not shown) mounted therein. The conduits 19 and 20 are connected to the housing 11, and used at least for lubrication of the engine and other purposes disclosed below.

Figure 3B:
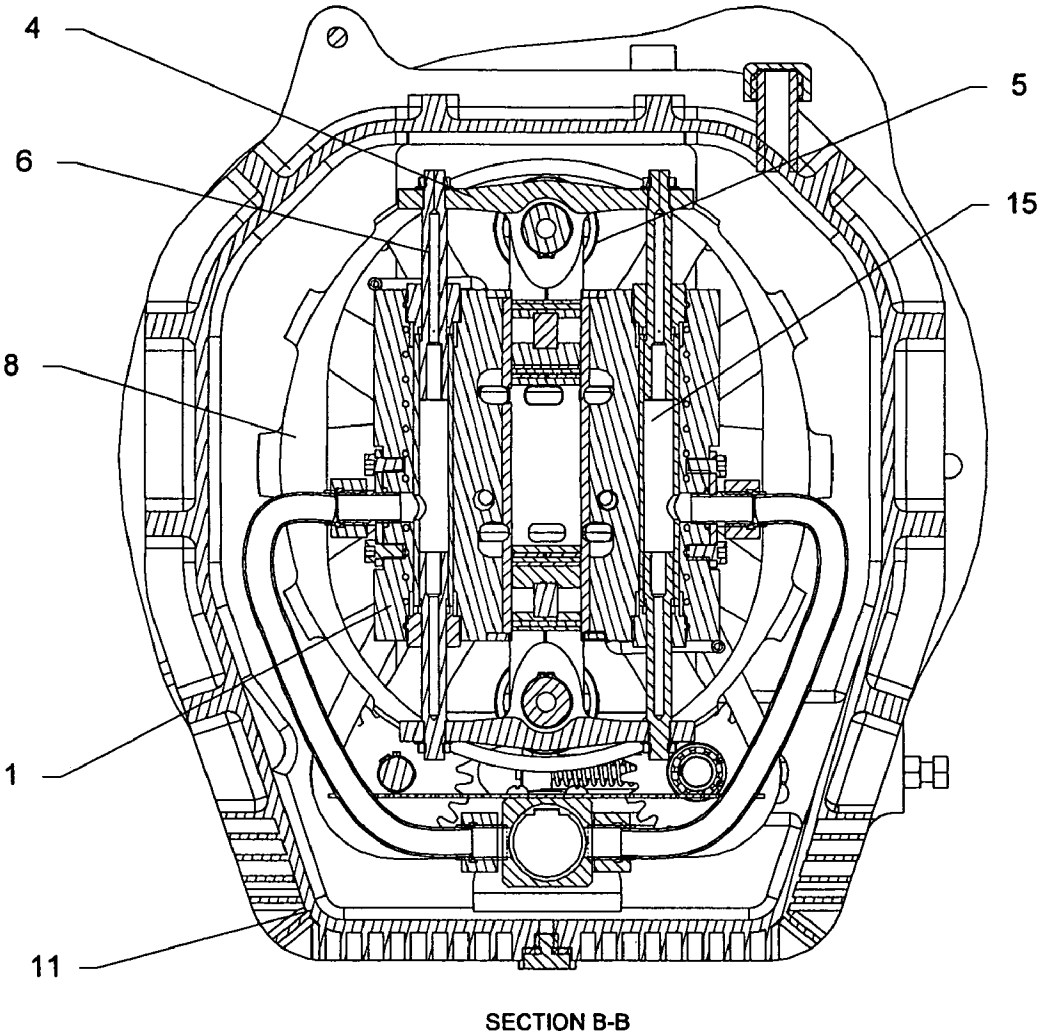
FIG. 3*b* illustrates a frontal sectional view of the engine, showing the design of the plungers, plungers' tubes, and other base units and parts of the engine's construction, according to a preferred embodiment of the present invention.
Figure 3A:
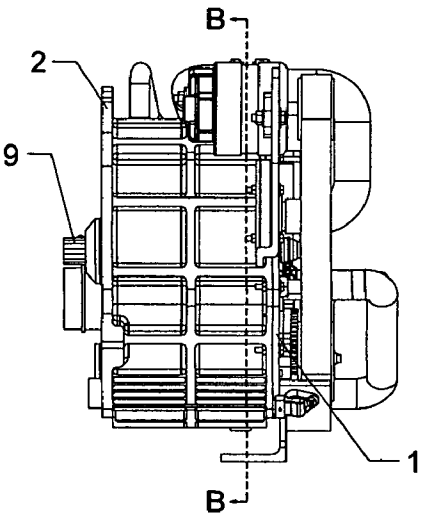
FIG. 3*a* illustrates a general side view of the assembled engine, according to a preferred embodiment of the present invention.

The engine comprises an oil pump, shown in FIGS. 3*b*, 4*a*, 4*b* including two sections, each comprising a tube (15) and two opposite plungers (6) slidely snug-fitting within each tube 15. Each plunger 6 has a piston portion and a rod portion. The rod portions of plungers 6 are attached to the traverses 4 (as shown in FIG. 3*b*) by means of pins (not shown). In a preferred embodiment, a second gap between the pump tube 15 and the plungers 6 is made in the size of about 2-4 micrometers, i.e. essentially less than the first gap.

The tube 15 has an oil suction inlet connected to the oil supply conduit 19 and an oil discharge outlet connected to the oil withdraw conduit 20, which inlet and outlet are drilled in the pump tubes, as depicted in FIGS. 4*a* and 4*b*.

The oil pump includes guide bushings (18) coupled to both the ends of each tube 15, as shown in FIG. 4*a*. The bushings 18 serve to close the tube 15 at its ends, and to guide the linear movement of the rod portion of plunger 6.

FIGS. 4*a* and 4*b* show: inward head surfaces (D) of the piston portions of plungers 6 inside the tube 15, so that the two surfaces D are facing each other; outward surfaces (C) of the piston portions of plungers 6 facing the bushings 18; an internal space (A) formed between the inward surfaces D and the inner sidewalls of the tube 15; external spaces (B) formed between the outward surfaces C, the rod portion sidewalls and the inner sidewalls of the bushings 18.

The oil pump includes two oil drain pipes (21), each communicating the external spaces B with the oil suction inlet (FIGS. 4*a* and 4*b*).

Each plunger 6 includes a through throttling channel (22) drilled preferably along the longitudinal axe of plunger 6 with a predeterminedly small diameter to provide necessary resistance to the oil cross-flow therethrough. The purpose of making the channel 22 is to prevent the device from destroying by a hydro-impact during its operation. The channel 22 has a perpendicular through portion capable to communicate the channel 22 with the space B.

The plungers 6 perform several important functions in the engine. A first function is the pumping of oil, which is a regular lubrication function common for an oil pump.

A second function of the plungers 6 is the absorption of side forces caused by the interaction between the rollers 5 and the rotor 8. Since the gap between the sleeve 2 and the piston 3 is essentially greater than the gap between the pump tube 15 and the plunger 6 (the size of 50 micrometers against the size of from 2 micrometers to 4 micrometers respectively), the plunger 6 absorbs the aforesaid side forces.

A third function of the plungers 6 is the providing for parallel movement of the pistons 3 within the sleeve 2 due to the absorption of aforesaid side forces.

A fourth function of the plungers 6 is the providing for a predetermined volume of the combustion chamber and for absorption of inertial forces developed by the pistons 3 and substantially exerted onto the rotor 8. This is achieved due to operation of the plungers 6 as "hydro-lock" valves in a hydro-system in the uppermost and lowermost dead points of the piston's traveling.

OPERATION OF THE PREFERRED INVENTIVE EMBODIMENT

FIG. 1*b* illustrates the positions of the pistons 3 with the traverses 4 situated in the uppermost dead-point wherein a common combustion chamber is formed by the pistons' heads and a respective portion of the sleeve's inner sidewalls (the uppermost dead-point corresponds to the minimal volume of the common combustion chamber). In the positions, a spark is produced by the spark-plug 16, igniting the fuel-air mixture in the combustion chamber that moves the pistons 3 with the traverses 4 in the opposite directions. The rollers 5 depress the rotor's inner curved operation surface, impelling the rotor 8 to spin, which rotates the takeoff shaft 9.

Figure 2B:
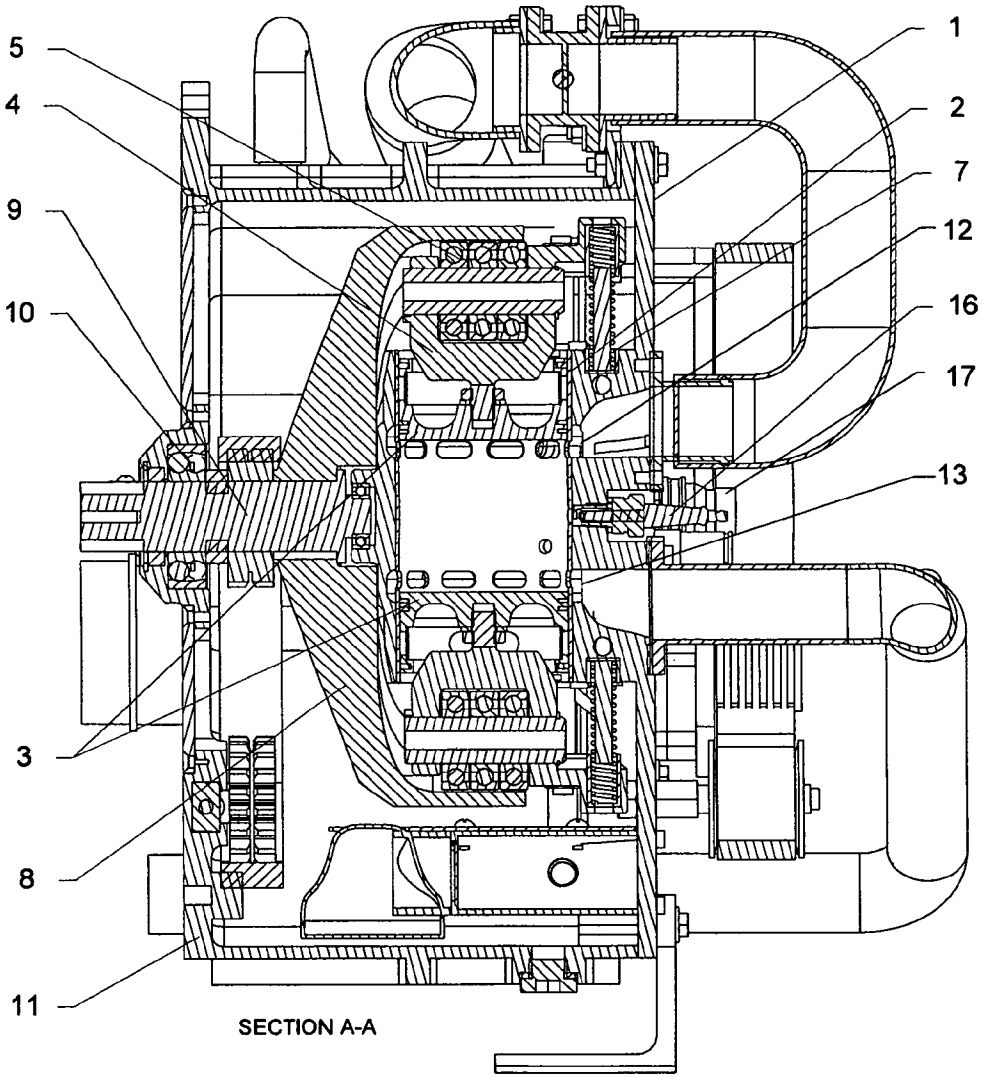
FIG. 2*b* illustrates a side sectional view of the engine in the lowermost "dead point" of the rotor and shows base units and parts of the engine's construction, according to a preferred embodiment of the present invention.
Figure 2A:
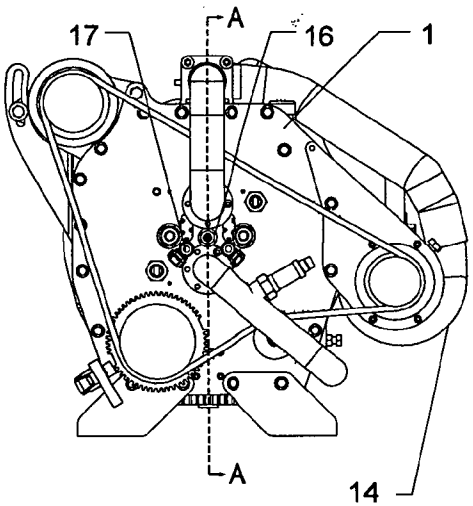
FIG. 2*a* illustrates a general frontal view of the assembled engine, according to a preferred embodiment of the present invention.

During the further traveling of the pistons 3 up to a 90 degrees turn of the rotor 8 (the lowermost dead-point corresponds to the maximal volume of the common combustion chamber, depicted in FIG. 2*b*), the inlet port 12 and outlet port 13 are opened that provides for blowing the combustion products out and filling up the cylinder's sleeve 2 with a portion of fresh air supplied by the compressor 14.

During the next 90 degrees turn (not illustrated), the rotor 8 spins due to inertia, pushing the pistons 3 via the rollers 5 and traverses 4, which results in the movement of pistons towards each other up to the uppermost dead-point, compressing the air in the sleeve 2. After the pistons 5 pass the inlet port 12 and the outlet port 13, a portion of fuel is injected into the combustion chamber through the injector 17. The mixture of fuel and air is intensely intermingled in the chamber up to the uppermost dead-point position of the pistons 3 (shown in FIG. 1*b*).

When a 180 degree turn of the rotor 8 is completed, the next spark is produced in the combustion chamber and the above-described two-stroke cycle is repeated. Therefore, the two-stroke cycle is performed during a 180-degree turn of the takeoff shaft, whereas, in a traditional piston internal combustion engine and all the aforementioned prior art engines, a two-stroke cycle is performed during a 360 degree turn. This doubles the frequency of the engine's cycles, resulting in an increase of its power.

Parallel processes occur in the oil tubes 15 and plungers 6 during operation of the engine. At the time when the pistons 3 travel to the lowermost dead-point, oil is sucked from the housing 11 into the supply conduit 19, and, via the oil suction inlet, into the expanding space A of the tube 15 (FIG. 4*a*). Simultaneously, oil is ejected from the space B into the drain pipes 21 by means of the inward surfaces C.

After the surfaces C pass the drain pipes 21, they will be closed by the piston portions of the plungers 6, and the oil left in the spaces B will prevent the further movement of the plungers 6 and, thusly, prevent the movement of the pistons 3 associated with the plungers 6 through the traverses 4. This situation is known as a "hydro-lock" in the space B, and it causes the lowermost dead-point of the engine. The aforementioned throttling channels 22 prevent the plungers and other mechanisms associated therewith from destroying by a hydro-impact taking place at the abrupt stop of the plungers 6, caused by the hydro-lock.

During the reverse movement of the plungers 6, the space A is contracting (FIG. 4*b*) and oil is ejected therefrom by the surfaces D into the withdraw conduit 20 via the oil discharge outlet. After the surface D passes the oil suction inlet, the oil left in the space A is confined and forms a hydro-lock in the space A, which determines the position of the uppermost dead-point of the engine.

Due to the absence of a crank-shaft, the side forces taking place in the crank-shaft and inertial loads caused by the crank-shaft rotation are substantially eliminated. This reduces friction losses by about 50%, and accordingly lessens the fuel consumption and saves a fuel amount necessary to cover the friction losses. The fuel efficiency of the engine leads to reduction of pollutions that makes the engine environmentally friendly.

We claim:

1. A two-stroke opposite radial rotary-piston engine comprising a stationary housing;

a stationary cylinder block assembled with the housing, said block including a cylindrically shaped sleeve having inner sidewalls, and two cylindrical pistons each having a bottom head facing each other, said pistons slidely disposed in the sleeve so that a first gap of a predetermined size being formed between the inner sidewalls of said sleeve and the pistons, said pistons being oppositely movable in relation to each other so that a common work chamber and a common combustion chamber formed by the bottom heads and the inner sidewalls of said sleeve;

a rotor having a closed inner operation surface formed by a predeterminedly curved line, said rotor is revolvably supported substantially by the housing and the cylinder block;

two traverses each attached to one of said pistons;

a number of support rollers attached to each of said traverses, said rollers being springly depressed against said rotor;

two stationary oil pump tubes, said tubes closed from both ends with guide bushings, said tubes including tube's inner sidewalls, said bushings including bushings' inner sidewalls;

oil supply means for at least supplying oil into said tubes;

oil withdraw means for at least withdrawing oil from said tubes;

two plungers slidely disposed within each of said tubes so that a second gap of a predetermined size being formed between the plungers and the tube's inner sidewalls, the size of the first gap being essentially greater than the size of the second gap, said plungers attached to said traverses and oppositely movable in relation to each other being guided by the guide bushings, said plungers each including a longitudinal through throttling channel and an outward surface, said bushings' inner sidewalls and said outward surfaces substantially forming two external spaces, said plungers each including an inward surface, said inward surfaces and said tube's inner sidewalls forming an internal space, said internal space communicating with said oil supply means and said oil withdraw means; and oil drain means for communicating the external spaces with said oil supply means.

2. The engine according to claim 1, wherein the predetermined curved line being either a closed symmetrical ellipse-type line or a Cassini line.

3. The engine according to claim 1, wherein the predetermined size of the first gap being equal substantially to 50 micrometers, and the predetermined size of the second gap being chosen from the range of from 2 to 4 micrometers.

* * * * *